US005176155A

United States Patent [19]

Rudolph, Jr.

[11] Patent Number: 5,176,155

[45] Date of Patent: Jan. 5, 1993

[54] METHOD AND DEVICE FOR FILING NAILS

[76] Inventor: James M. Rudolph, Jr., 1150 Beacon St., Brea, Calif. 92621

[21] Appl. No.: 845,060

[22] Filed: Mar. 3, 1992

[51] Int. Cl.[5] ..... A45D 29/18

[52] U.S. Cl. ..... 132/76.4; 132/200; 51/181 R; 51/204; 51/401

[58] Field of Search ..... 132/73, 75.6, 76.5, 132/76.5, 200; 51/181 R, 204, 205 R, 401, 407

[56] References Cited

U.S. PATENT DOCUMENTS 2,225,567 12/1940 Neuschaefer ..... 132/76.4
3,298,381 1/1967 Adams ..... 132/76.4
4,712,552 12/1987 Pangburn ..... 132/76.4

*Primary Examiner*—Gene Mancene
*Assistant Examiner*—Frank A. LaViola
*Attorney, Agent, or Firm*—John Connors

[57] ABSTRACT

Disclosed is a method of filing a synthetic nail comprising rubbing the nail with a unique device that captures dust produced by filing. The device includes an elongated, rigid, support member having a generally flat, planar support surface. A foam strip is attached to the planar surface of the rigid support member and it has a generally flat, planar, tacky support surface. An abrasive member is bonded to the planar support surface of the foam strip comprising a crisscrossed arrangement of spaced apart, thread-like filaments having gritty abrasive material embedded therein. The crisscross arrangement of filaments forms a plurality of cavities open at the surface of the abrasive member to collect and hold therein nail dust produced upon rubbing the abrasive member against a nail.

13 Claims, 1 Drawing Sheet

METHOD AND DEVICE FOR FILING NAILS

BACKGROUND OF THE INVENTION

1. Field of the Invention

This invention relates to a method and device for filing human finger and toenails, and particularly, for filing synthetic nails bonded to human finger and toenails.

2. Background Discussion

Synthetic nails are frequently used to improve the strength and appearance of human nails. Such synthetic nails, usually made of an acrylic polymeric material, are bonded to the surface of human nails and then shaped by filing. One type of nail file commonly used comprises a support member having a foam material bonded to the support member and a sandpaper glued to the surface of the foam. There is a problem encounter when filing synthetic nails with such a conventional nail file. A dust is produced which, in many instances, irritates the eyes, nose and skin of persons in the vicinity. This dust may poses a heath hazard to some sensitive individuals.

SUMMARY OF THE INVENTION

It is the objective of this invention to provide a nail filing device which captures a substantial amount of the dust produced during nail filing.

Broadly, the nail filing device of this invention comprises an elongated, rigid, support member having support surface, and an abrasive member bonded to the support surface having a plurality of cavities therein open at the surface of the abrasive member and having an internal tacky surface to which nail dust adheres when produced upon rubbing the abrasive member against a nail. This invention also includes a method of filing a synthetic nail by rubbing the nail with the device of this invention. This method is especially useful in filing an acrylic nail. In this method, the device is periodically cleaned to remove captured nail dust by rinsing with water.

A foam strip is attached to the support surface of the rigid support member and this foam strip has a generally flat, planar, tacky support surface. An open screen-like abrasive member is bonded to the planar support surface of the foam strip. This abrasive member comprises a crisscrossed arrangement of spaced apart, thread-like filaments having gritty abrasive material embedded in the filaments. The crisscrossed arrangement of filaments forms the open top cavities which have a tacky floor formed by the tacky adhesive surface of the foam strip. The dust adheres to this floor. These cavities thus collect and hold the nail dust produced upon rubbing the abrasive member against a nail.

The filaments typically have an average diameter from 1/64 to ⅛ inch. The abrasive member has a mesh from 1/64 to 1/16 inch, and a grit from 80 to 1200. The cavities typically have a depth ranging between 1/64 and ⅛ inch, and a volume ranging from 0.0002 to 0.02 cubic inch. The support member, foam strip, and abrasive member are made of water resistance materials. Preferably, both sides of the support member are covered by foam strips with the tacky surfaces of the strips having the open screen-like abrasive member bonded to them.

The device and method of this invention have several features, no single one of which is solely responsible for their desirable attributes. Without limiting the scope of this invention as expressed by the claims which follow, its more prominent features will now be discussed in the section of this application entitled, "DETAILED DESCRIPTION OF THE PREFERRED EMBODIMENT." After considering this preferred embodiment of the invention, one will understand how its features provide its advantages, which include simplicity of use and substantial reduction of airborne nail dust.

DESCRIPTION OF THE DRAWING

The preferred embodiment of this invention, illustrating all its features, is shown in the accompanying drawing, which is for illustrative purposes only. This embodiment depicts the novel and non-obvious method and device of this invention. This drawing includes the following figures (FIGS.), with like numerals indicating like parts.

DESCRIPTION OF THE PREFERRED EMBODIMENT

Figure 1:
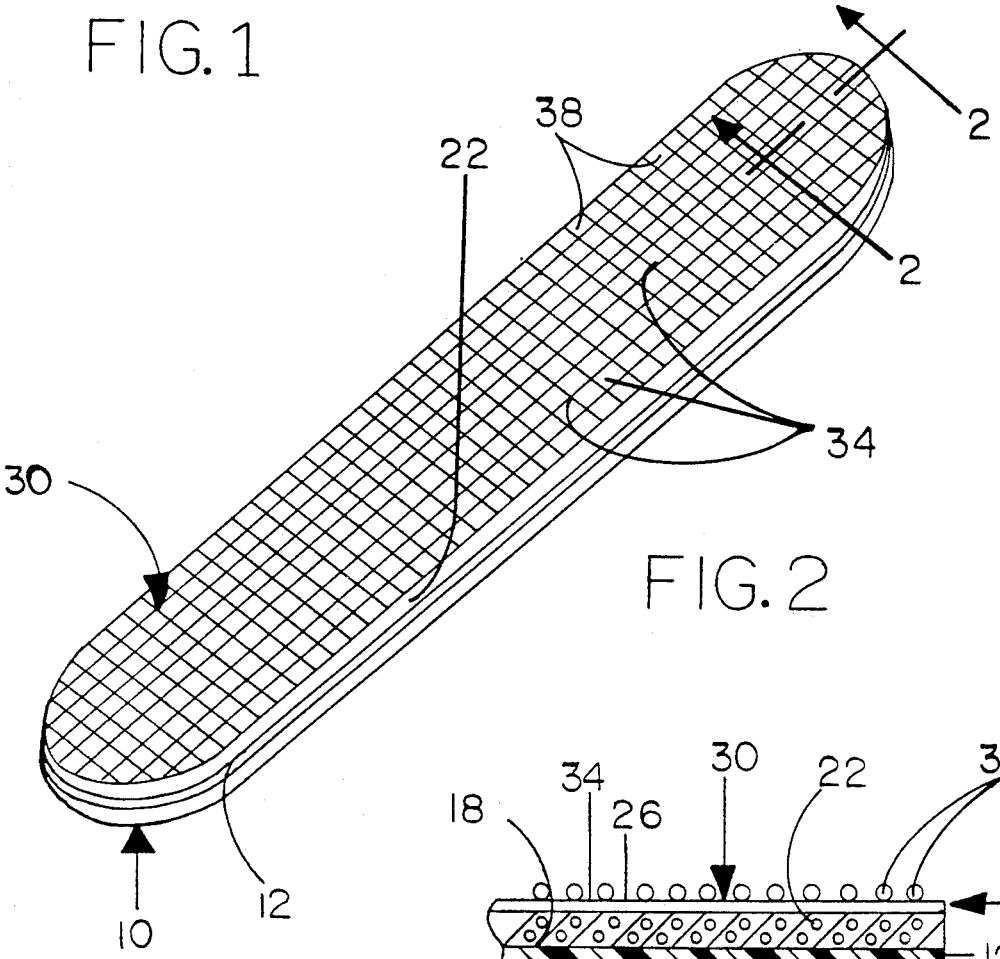
FIG. 1 is a perspective view of the nail filing device of this invention.
Figure 2:
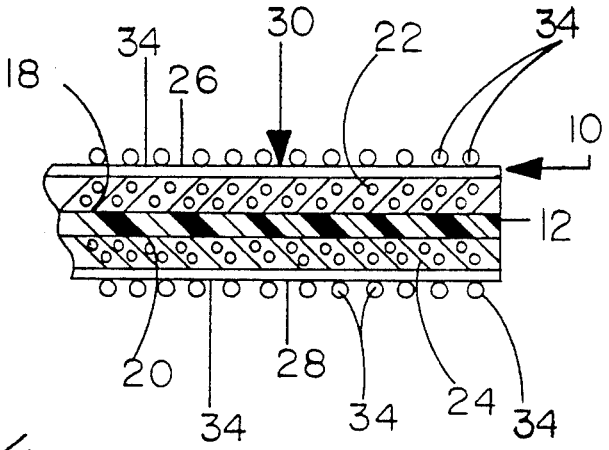
FIG. 2 is a cross-sectional view taken along line 2—2 of FIG. 1.
Figure 3:
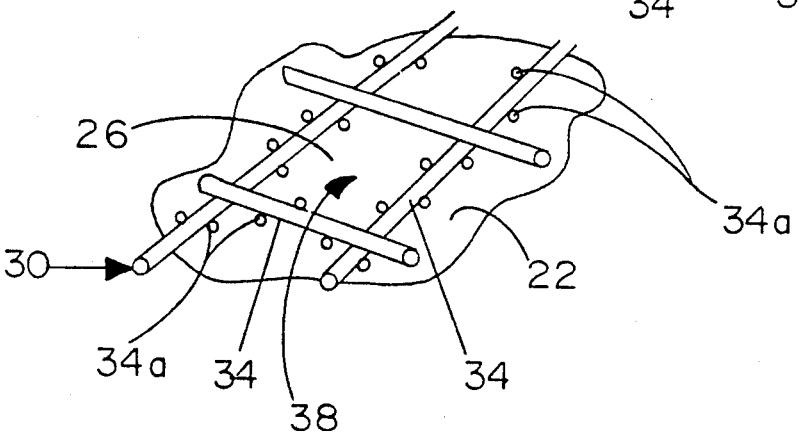
FIG. 3 is an enlarged, fragmentary perspective view of a segment of the surface of the nail filing device, showing a dust capturing cavity formed between filaments.

As illustrated in FIGS. 1 through 3, the nail filing device 10 of this invention includes an elongated support member 12, preferably made from a polymeric material such as a strip of polystyrene. Both the topside and underside of the support member 12 are generally flat, smooth, planar surfaces 18 and 20, respectively. Adhering to and covering these surfaces 18 and 20 are, respectively, foam sheets 22 and 24, each having a thickness of from 1/64 to ½ inch. Suitable foam sheets 22 may be obtained from the Avery Corporation sold under the trademark VOLERA. This foam material has a long-lasting, tacky adhesive on both sides of a closed cell polyurethane foam strip. Thus, when pressed firmly against the support member 12, the foam sheets 22 and 24 bond, respectively, to the flat, smooth surfaces 18 and 20.

Each of the foam sheets 22 and 24 present flat, smooth, and tacky support surfaces 26 and 28, respectively. Bonded to these surfaces 26 and 28 are abrasive members 30 and 32, respectively. Suitable abrasive members may be obtained from Norton Consumer Products of Worchester, Massachusetts. These members 30 and 32 are essentially screen clothes coated with sharp, silicon carbide abrasive on both sides of the clothes. Each of these abrasive members 30 and 32 comprise a number of filaments 34, which have tiny, gritty, silicon carbide particulates 34*a* (FIG. 3) embedded in the filaments. These filaments are arranged in a crisscrossed configuration, generally at right angles to form, when carried on the support surfaces 26 and 28, cavities 38. These cavities 38 each have an open top at the surface of the abrasive members 30 and 32 through which dust particles enter the cavities. The floors of the cavities 38 are the tacky surfaces 26 and 28, respectively, of the foam sheets 22 and 24. Dust particles stick to these surfaces 26 and 28.

To use the device 10, one simply rubs the filaments 34 against a finger nail, unavoidably producing nail dust. Most of this nail dust is captured in the cavities 38, sticking to the floors of the cavities, the surfaces 26 and 28. Experimental data indicates that as much as 70% of the nail dust produced is captured. One periodically cleans the device 10 by simply rinsing in water. Since all the materials are water resistant, the device 10 may be rinsed repeatedly and reused.

SCOPE OF THE INVENTION

The above presents a description of the best mode contemplated of carrying out the present invention, and of the manner and process of making and using it, in such full, clear, concise, and exact terms as to enable any person skilled int he art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the intentions generally expressed by the following claims, which particularly point out and distinctly claim the subject matter of the invention;

I claim:

1. A device for filing nails, including an elongated, rigid, support member having support surface, and an abrasive member bonded to the support surface having a plurality of cavities therein open at the surface of the abrasive member and having an internal tacky surface to which nail dust adheres that is produced upon rubbing the abrasive member against a nail.

2. The device of claim 1 including a foam strip attached to the support surface of the rigid support member, said foam strip having a generally flat, planar, tacky, support surface.

3. The device of claim 2 where the abrasive member is bonded to the planar support surface of the foam strip comprising a crisscrossed arrangement of spaced apart, thread-like filaments having gritty abrasive material embedded therein.

4. The device of claim 3 where the filaments have an average diameter from 1/64 to $\frac{1}{8}$ inch.

5. The device of claim 3 where the abrasive member has a mesh from 1/64 to $\frac{1}{8}$ inch.

6. The device of claim 3 where the abrasive member has a grit from 80 to 1200.

7. The device of claim 1 wherein the cavities have a depth ranging between 1/64 and $\frac{1}{8}$ inch, and a volume ranging from 0.0002 to 0.02 cubic inch.

8. The device of claim 2 where the support member, foam strip, and abrasive member are made of water resistance materials.

9. A device for filing nails, including an elongated, rigid, support member having a generally flat, planar support surface, a foam strip attached to the planar support surface of the rigid support member and having a generally flat, planar, tacky, support surface, and an abrasive screen-like member bonded to the planar support surface of the foam strip comprising a crisscrossed arrangement of spaced apart, thread-like filaments having gritty abrasive material embedded therein, said abrasive member having a mesh from 1/64 to $\frac{1}{8}$ inch, and a grit from 80 to 1200, said filaments having an average diameter from 1/64 to $\frac{1}{8}$ inch and arranged generally at right angles to each other, said crisscrossed arrangement of filaments forming a plurality of cavities open at the surface of the abrasive member to collect and hold therein nail dust produced upon rubbing the abrasive member against a nail, said cavities having a depth ranging between 1/64 and $\frac{1}{8}$ inch, and a volume ranging from 0.0002 to 0.02 cubic inch.

10. The device of claim 9 where the support member, foam strip, and abrasive member are made of water resistance materials.

11. A method of filing a synthetic nail comprising rubbing the nail with a device, including an elongated, rigid, support member having support surface, and an abrasive member bonded to the support surface having a plurality of cavities therein open at the surface of the abrasive member and having an internal tacky surface to which nail dust adheres that is produced upon rubbing the abrasive member against a nail.

12. The method of claim 11 where the synthetic nail is an acrylic nail.

13. The method of claim 11 where the support member, foam strip, and abrasive member are made of water resistance materials, and the device is periodically cleaned to remove captured nail dust by rinsing with water.

* * * * *